US006485033B2

(12) United States Patent
Nicoletti et al.

(10) Patent No.: US 6,485,033 B2
(45) **Date of Patent: *Nov. 26, 2002**

(54) ICE SKATE WITH INTERCHANGEABLE BLADES

(75) Inventors: Graziano Nicoletti, Treviso (IT); Antonio Favero, Montebelluna (IT)

(73) Assignee: Bauer Italia S.p.A. (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/115,966

(22) Filed: Jul. 15, 1998

(65) Prior Publication Data

US 2002/0140186 A1 Oct. 3, 2002

(30) Foreign Application Priority Data

Jul. 15, 1997 (IT) ..... PD97A0159

(51) Int. Cl.[7] ..... A63C 1/99
(52) U.S. Cl. ..... 280/11.18; 280/11.12
(58) Field of Search ..... 280/11.12, 11.16, 280/11.17, 11.18, 11.19, 11.2, 11.22, 11.27, 7.13, 7.15

(56) References Cited

U.S. PATENT DOCUMENTS

| | | | | | |
|---|---|---|---|---|---|
| 2,548,391 | A | * | 4/1951 | Petrime | 280/7.13 |
| 2,874,970 | A | * | 2/1959 | Mall | 280/7.13 |
| 4,139,209 | A | | 2/1979 | Humphreys | 280/11.12 |
| 4,351,536 | A | * | 9/1982 | Sandino | 280/7.13 |
| 4,379,563 | A | | 4/1983 | Arsenault | 280/7.13 |
| 4,932,675 | A | * | 6/1990 | Olson et al. | 280/7.13 |
| 5,193,827 | A | * | 3/1993 | Olson | 280/7.13 |
| 5,314,199 | A | * | 5/1994 | Olson et al. | 280/7.13 |
| 5,393,077 | A | * | 2/1995 | Wanous | 280/7.13 |
| 5,484,148 | A | * | 1/1996 | Olivieri | 280/11.18 |
| 5,505,467 | A | * | 4/1996 | Hill et al. | 280/11.16 |
| 5,524,912 | A | * | 6/1996 | Laub et al. | 280/7.13 |
| 5,595,392 | A | * | 1/1997 | Casillas | 280/7.13 |
| 5,906,380 | A | * | 5/1999 | Searby et al. | 280/7.13 |
| 5,988,683 | A | * | 11/1999 | Venier et al. | 280/841 |

FOREIGN PATENT DOCUMENTS

| | | | | |
|---|---|---|---|---|
| DE | 78716 | | 12/1894 | |
| DE | 4300053 | A * | 7/1994 | 280/7.13 |
| WO | 95/34352 | | 12/1995 | |

* cited by examiner

*Primary Examiner*—Paul N. Dickson
*Assistant Examiner*—L. Lum
(74) *Attorney, Agent, or Firm*—RatnerPrestia

(57) ABSTRACT

An ice skate with interchangeable blades. The ice skate comprises a body defining a seat for housing a blade-holder to be clamped against the body, and a plurality of sets of blades and respective blade-holders, in which at least the blades of the sets have different geometrical configurations and each set of a blade and a blade-holder is interchangeably replaceable in the seat of the body so that blades of different geometrical configurations can be mounted on the skate, preferably in order to use the skate for different disciplines.

29 Claims, 5 Drawing Sheets

IV
IV
III
III
1
2
3
4
7a
22
23
27
29

1
2
3
4
5
6a
7a
8a
15
16
20
22
23
24
25
26
27
29

ICE SKATE WITH INTERCHANGEABLE BLADES

FIELD OF THE INVENTION

The present invention relates to an ice skate with interchangeable blades.

BACKGROUND OF THE INVENTION

In the specific technical field, ice skates which have blades arranged for fixing releasably to the body of the skate so that the user can change the blade without having to replace the body of the skate or the associated boot are known. These skates generally only permit interchangeable replacement of blades of identical configuration and the user is consequently forced to equip himself with a different pair of skates for each of the skating disciplines which he intends to practice such as, for example, ice hockey, for which short, thick blades are required, or speed skating for which, on the other hand, relatively long, thin blades are required.

There are also known skates in which the blade is arranged to be fixed to a blade-holder which in turn is intended to be clamped against the body of the skate. However, this type of skate also only permits interchangeable replacement of blades of identical geometrical configuration and consequently has the same disadvantages for the user as that described above.

SUMMARY OF THE INVENTION

The problem solved by the present invention is that of providing an ice skate which is designed structurally and functionally so as to overcome all of the problems identified above with reference to the prior art mentioned.

To solve these problems, and in view of its purposes, the present invention provides an ice skate with interchangeable blades. The ice skate has a body defining a seat which receives a blade holder clamped against the body. The ice skate comprises a plurality of sets of blades and respective blade-holders, the blades of each of the sets having different geometrical configurations. Each set of blades is interchangeably replaceable in the body so that blades of different geometrical configurations can be mounted on the skate. This allows the skate to be used for different skating disciplines.

BRIEF DESCRIPTION OF THE DRAWING

The characteristics and the advantages of the invention will become clearer from the following detailed description of some embodiments thereof, described by way of non-limiting example with reference to the appended drawings, in which.

DETAILED DESCRIPTION OF THE INVENTION

Figure 1:
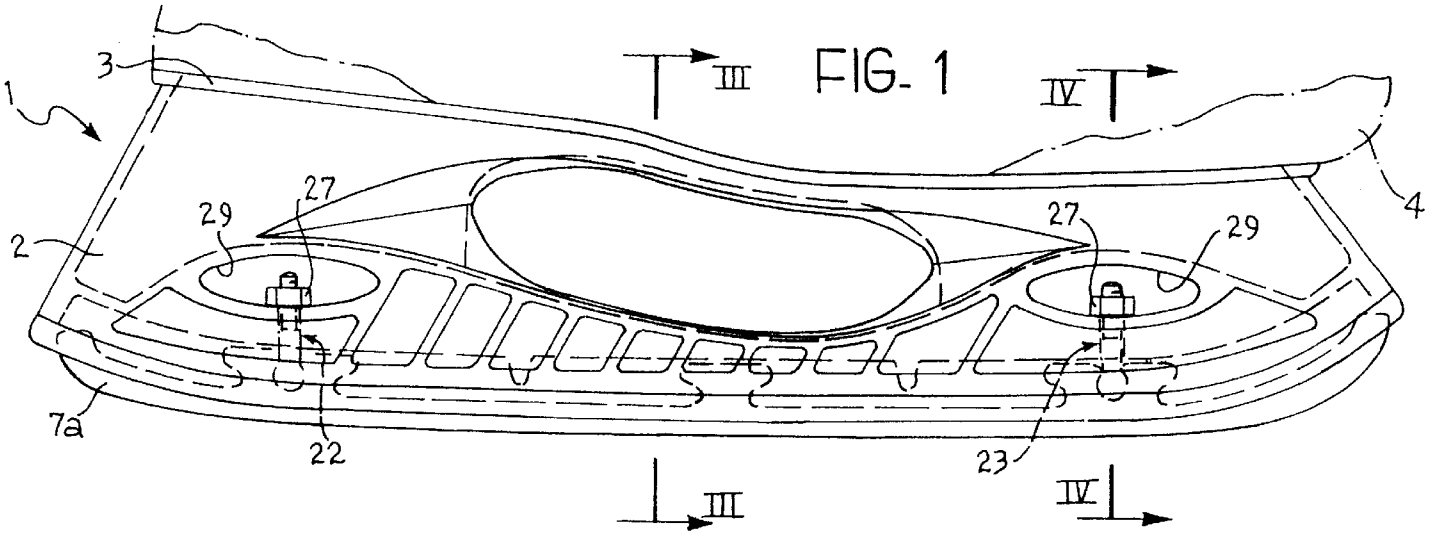
FIG. 1 is a side elevational view of a first embodiment of an ice skate formed in accordance with the present invention.
Figure 2:
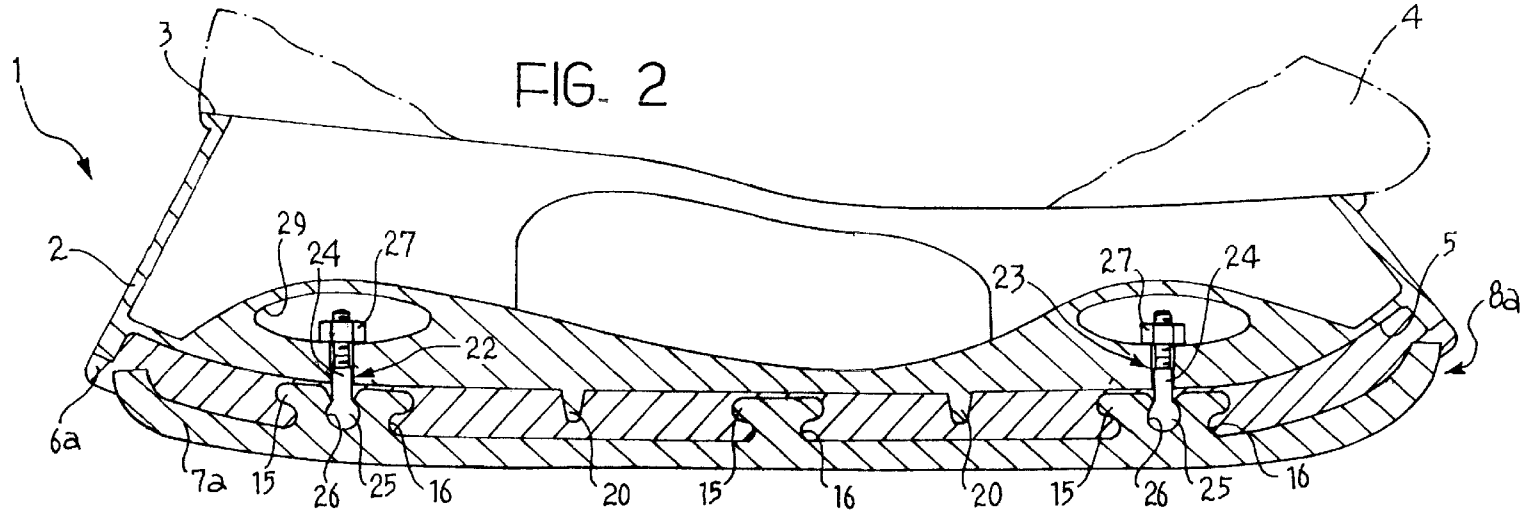
FIG. 2 is a longitudinal section of the skate of FIG. 1, FIGS. 3 and 4 are sections taken on the lines III—III and IV—IV of FIG. 1, respectively, on an enlarged scale.
Figure 3:
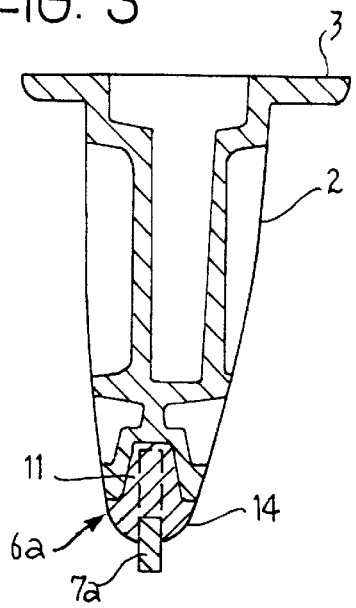
Figure 4:
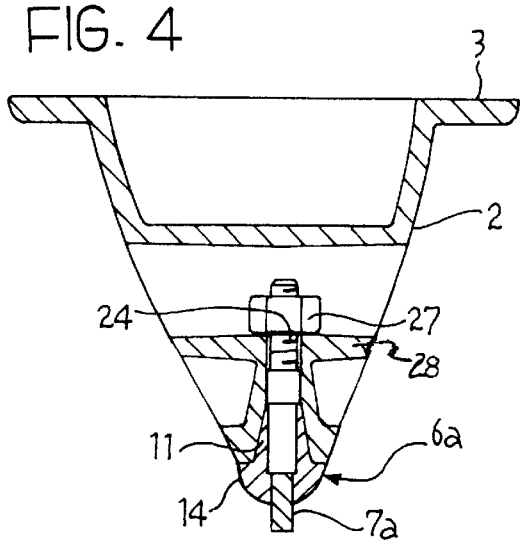

With reference to FIGS. 1 and 2, a first embodiment of an ice skate with interchangeable blades formed in accordance with the present invention is generally indicated 1.

The skate 1 comprises a partially hollow body 2 carrying an attachment flange 3 for fixing to the body of a boot 4, shown only partially in the drawings. On the opposite side to the attachment flange 3, the body has a groove 5 constituting a seat for housing a blade-holder 6*a* arranged for supporting a respective blade 7*a* and for being clamped against the body 2, as will be described in detail below.

Figure 5:
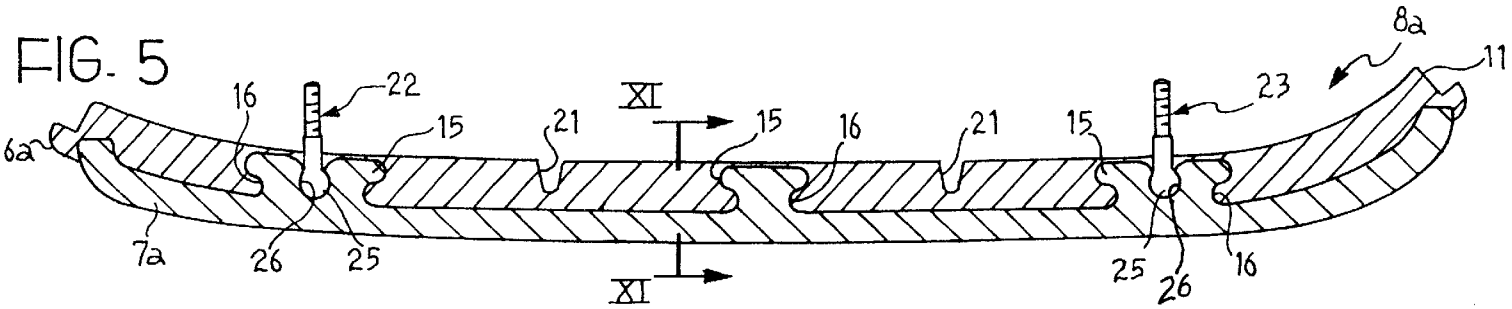
FIGS. 5, 6 and 7 are longitudinal sections of three different embodiments of a detail of the skate of the preceding drawings, respectively.
Figure 6:
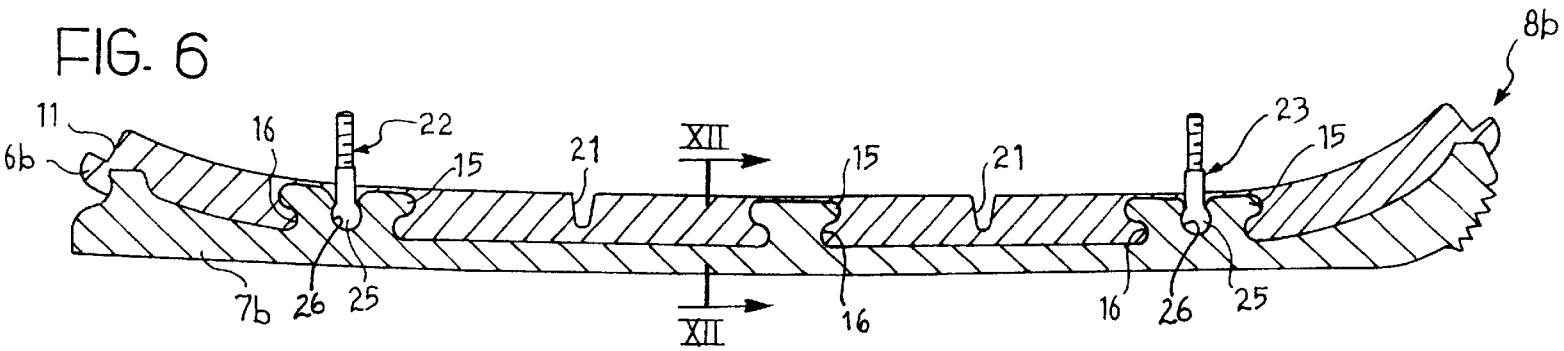
Figure 7:
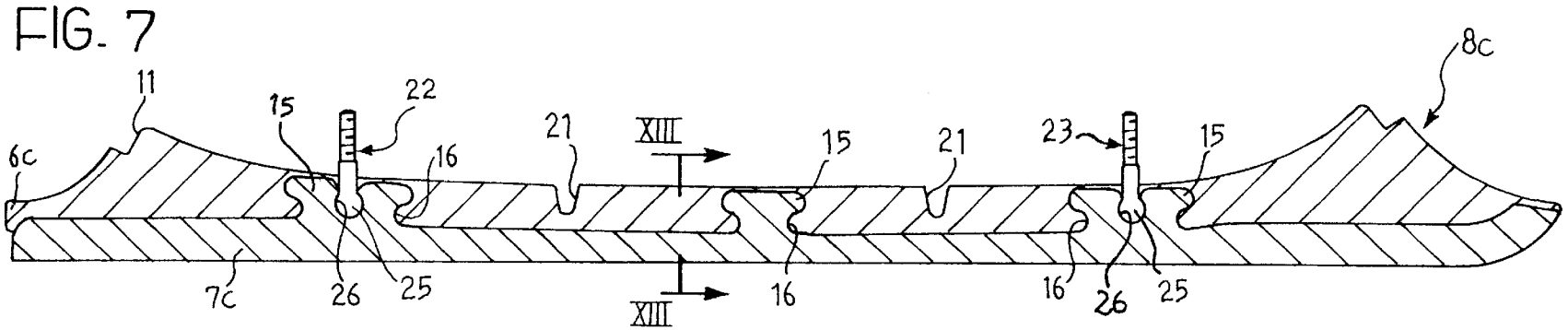
Figure 11:
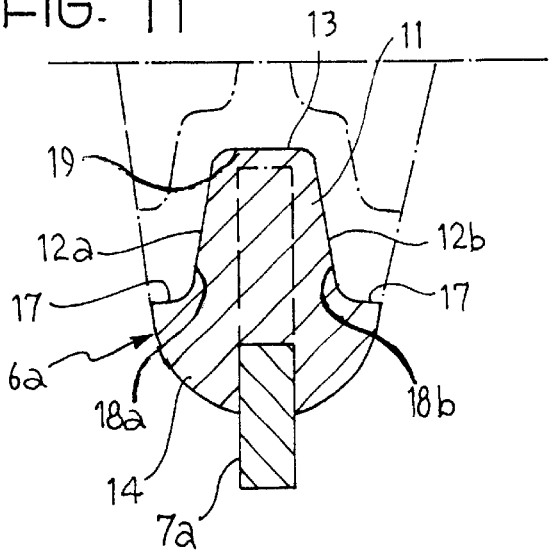

The skate 1 also comprises a plurality of sets of blades and respective blade-holders which are interchangeably replaceable in the seat 5 of the body 2. FIGS. 5 to 7 show three embodiments of sets of blades and respective blade-holders, generally indicated 8*a*, 8*b* and 8*c*, the blades 7*a*, 7*b*, 7*c* of which have different geometrical configurations, designed specially for different skating disciplines. For example, the blade 7*a* of the set 8*a* is particularly suitable for ice hockey since it is relatively short and noticeably thick (FIGS. 5 and 11). The blade 7*b* of the set 8*b* has geometrical characteristics of length, thickness and curvature designed appropriately for figure skating. The blade 7*c* of the set 8*c*, on the other hand, is longer and thinner than the blades of the previous sets and is particularly suitable for speed skating. Each set 8*a*, 8*b*, 8*c* comprises a respective blade-holder 6*a*, 6*b*, 6*c* arranged for supporting the corresponding blade 7*a*, 7*b*, 7*c*. Preferably, each blade-holder is made of plastic material and is co-molded on the blade of the corresponding set.

An attachment portion, indicated 11, defined on each blade-holder 6*a*, 6*b* and 6*c*, is intended to be housed and clamped in the seat 5 of the body 2 so as to render each blade and blade-holder set interchangeably replaceable on the body of the skate. It is intended that the skate 1 may be equipped with a plurality of blade and blade-holder sets of which each is formed in accordance with the skater's specific sporting requirements and of which the sets 8*a*, 8*b* and 8*c* represent only three examples. It should be noted that the plurality of sets may comprise blades having different geometrical configurations combined with identical blade-holders, for example, as in the sets 8*a* and 8*b*, or blades having different geometrical configurations combined with blade-holders of different shapes such as, for example, those constituting the two sets 8*b* and 8*c*.

Figure 12:
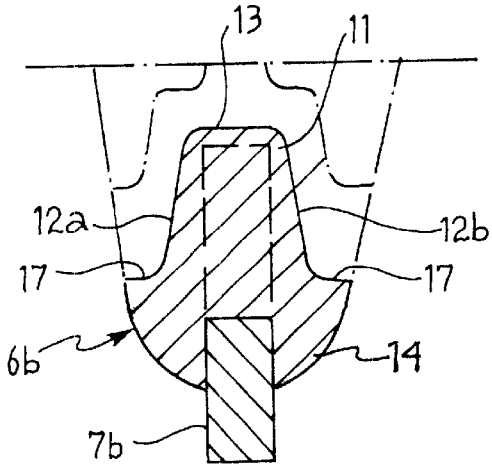
Figure 13:
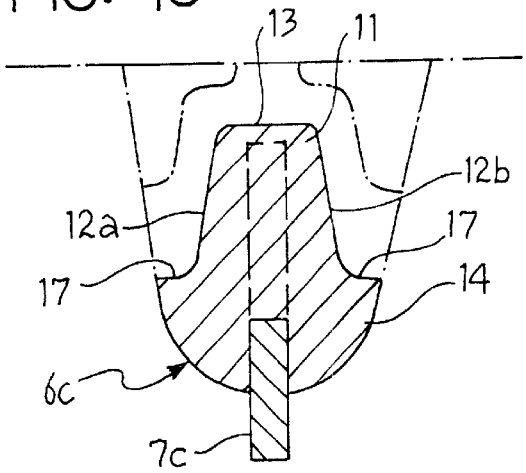

The attachment portion 11 of each blade-holder has a wedge-shaped cross section defined by opposed surfaces 12*a*, 12*b* and by a third connecting surface 13. See FIGS. 11–13. The attachment portion is extended on the side opposite the surface 13 by a second portion 14 in which the corresponding blade is partially incorporated. Each blade 7*a*, 7*b*, 7*c* has appendages, all indicated 15, extending into the attachment portion 11 and defining, with the respective blade, recesses 16 which serve to improve the ability of the blade to grip the corresponding blade-holder. Shoulders 17 defined between the portions 11 and 14 of the blade-holder constitute abutment surfaces for corresponding longitudinal edges of the seat 5 of the body.

The inclination of the surfaces 12*a*, 12*b* of the blade-holder is selected in a manner such that the attachment portion 11 is housed removably with a substantially shaped coupling in the seat 5 of the body which has opposed surfaces 18*a*, 18*b* extending from a base 19 and shaped in a corresponding manner in order to be engaged against the coupling surfaces of the attachment portion of the blade-holder.

Two respective stiffening elements, indicated 20, extend transversely in the seat 5 to connect the opposed surfaces 18*a*, 18*b*. The stiffening elements 20 are housed in corresponding recesses 21 in the blade-holder.

The skate 1 has a pair of rod-like ties, generally indicated 22 and 23, for clamping the blade of each blade and blade-holder set to the body 2. The system for clamping the blade-holder to the body will be described with reference to the blade 7*a* of the set 8*a*, this description being intended to be applicable to every blade and blade-holder set.

Each tie 22, 23 comprises a rod 24 housed for sliding in a hole in the body and carrying, at one of its ends, a head 25 which can be housed releasably with a shaped coupling in a corresponding recess 26 formed in the appendage 15 of the blade 7*a*. The shape of the recess 26 is such as to form, with the head 25, a coupling which is restrained in the direction of the axis of the rod. The head 25 is incorporated in the blade-holder 6*a* during its co-molding on the blade. In this embodiment, each set 8*a*, 8*b*, 8*c* has a pair of ties 22, 23. Alternatively, the ties may be mounted on the blade-holder removably so that the skate is equipped with a single pair of ties which can fit each of the blade and blade-holder sets provided.

At the opposite end to the head 25, the rod has a threaded portion which can be screwed into a restraining element such as a nut 27 which abuts a shoulder 28 of the body 2. Holes, all indicated 29, are formed in the opposite sides of the body 2 and are disposed adjacent the threaded ends of the ties when the blade-holder is mounted on the body, so that each nut 27 is accessible from outside the body in order, for example, to be tightened by means of a spanner inserted through the holes 29 in order to apply the desired clamping load to the corresponding tie. The holes 29 are preferably elliptical and elongate longitudinally relative to the body 2.

It will be appreciated that, by virtue of the provision of the holes 29 through which the restraining elements or nuts 27 are accessible from outside the body, the clamping or, alternatively, the removal of the blade holder 6*a* is effected without the need to remove the boot and without the need to have access to the inside of the boot in order to remove any means for the fixing of the blade.

The force generated in each tie 22, 23 as a result of the tightening of each nut 27 is such as to bring about a corresponding clamping pressure between the mutual contact surfaces of the blade-holder 6*a* and of the seat 5. The load for clamping the blade-holder and hence the blade against the body 2 is advantageously adjustable and controllable simply by the adjustment of the tensile force generated in the ties 22, 23 and the contact pressure between the mutually engaged surfaces of the blade-holder 6*a* and of the seat 5 of the body is consequently also correspondingly easy to control.

In FIGS. 1 and 2, the skate 1 is shown in an operative position in which the blade-holder 6*a* is housed in the seat 5 and the ties 22, 23 are screwed into the respective nuts 27. As a result of the tightening of the nuts 27, the attachment portion 11 of the blade-holder is clamped by being wedged in the seat 5 of the body. This forced clamping by wedging ensures the stiffness and structural continuity of the blade-holder relative to the body. It should be noted that each tie extends substantially parallel to the direction of the application of the clamping load which urges the blade-holder and the body into mutual wedging engagement. This clamping load is therefore substantially equal to the entire tensile force generated in the tie by the tightening of the nuts.

Figure 10:
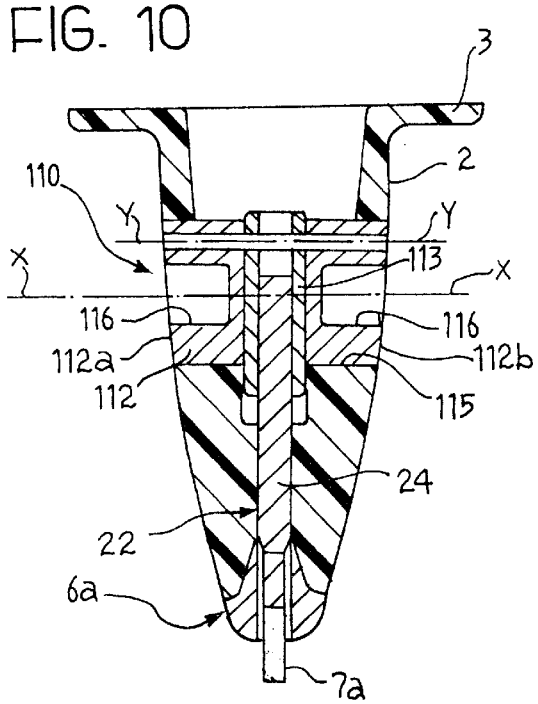
FIG. 10 is a section taken on the line X—X of FIG. 8, on an enlarged scale and, FIGS. 11, 12 and 13 are sections taken on the lines XI—XI, XII—XII and XIII—XIII of FIGS. 5, 6, and 7, respectively.
Figure 8:
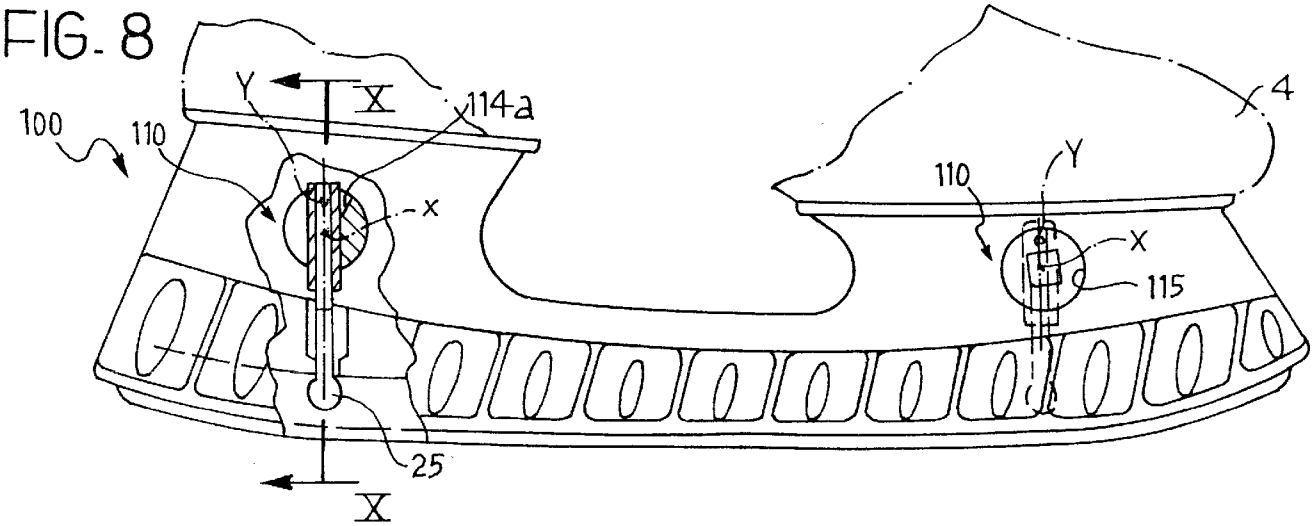
FIGS. 8 and 9 are partially-sectioned side elevational views of a second embodiment of the skate according to the invention.
Figure 9:
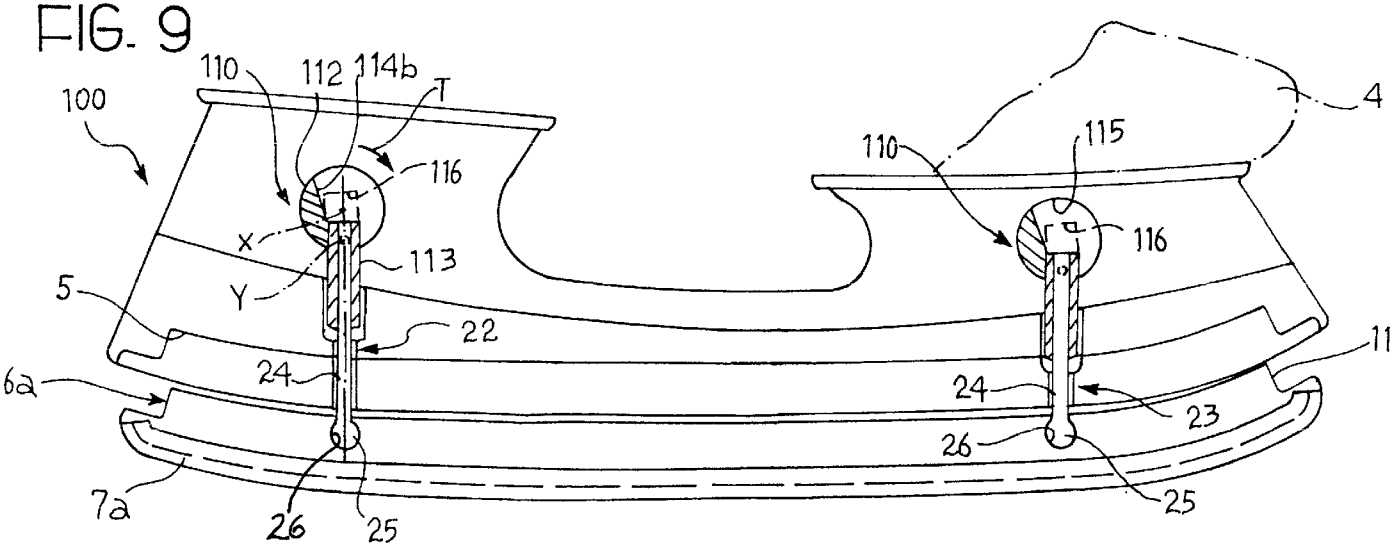

With particular reference to FIGS. 8 to 10, a second embodiment of the skate of the present invention, in which details similar to those of the previous embodiment are indicated by the same reference numerals, is indicated 100.

The skate 100 differs from the skate of the previous embodiment in that it comprises an eccentric device, generally indicated 110 and described in detail below, for clamping the blade-holder to the body.

The device 110 comprises, in the region of each tie 22, 23, a respective member 112 supported for rotation about an axis X between the sides of the body 2. The end of an element 113 forming an extension of the corresponding rod 24 is articulated to each member 112 in an eccentric position relative to the axis X. Each element 113 has an axial threaded cavity into which the threaded portion of the corresponding rod 24 is screwed. The element 113 is articulated about an axis Y parallel to the axis X and spaced therefrom, with a predetermined eccentricity.

The element 113 is partially housed in a recess in the member 112 in which two respective surfaces 114*a*, 114*b* are formed at an inclination to one another, constituting abutment surfaces for the corresponding tie 22, 23 in the operative position of the skate, shown in FIG. 8.

The member 112 has opposed faces 112*a*, 112*b* accessible from outside the body 2 through respective circular holes 115 formed in the sides of the body.

A respective recess 116 with a polygonal, for example, square cross-section is formed in each face 112*a*, 112*b* for the engagement of a corresponding wrench, not shown, supplied with the skate 100 for rotating the member 112 about the axis X.

In FIG. 9, the skate 100 is shown in an inoperative position, that is, a position in which the blade-holder 6a is removed from the seat 5. In this position, each member 112 associated with the respective tie 22, 23 is rotated in a manner such that the articulation axis Y of the element 113 is interposed between the axis X and the head 25 of the tie and the rod 24 consequently projects from the seat 5 to enable the blade-holder to be removed from the body. It can be seen that, in this removal position, the element 113 is in abutment with the abutment surface 114*a* which thus constitutes a limit for the angular travel permitted for the member 112.

Starting from the position of FIG. 9, in order to clamp the blade-holder 6*a* against the body 2, the member 112 is rotated in the direction of the arrow T of FIG. 9 until the element 113 is brought into abutment with the abutment surface 114*b*. In this position, the axis Y has moved, as a result of the eccentricity, to the opposite side of the axis X to the head 25 of each tie, bringing about the sliding of the tie relative to the body which is necessary to move the blade-holder and clamp it in the seat 5.

By virtue of the adjustable coupling of the rod 24 (the threaded portion) with the element 113, it is possible to adjust the length of the tie and consequently to vary the tensile stress produced therein by means of the eccentric device 110. The desired clamping load between the blade-holder and the body can therefore be applied and regulated by adjustment of the tie 22, 23.

It will also be appreciated that, by virtue of the above-described eccentric clamping device the same clamping load can easily be applied repeatably between the blade-holder and the body in a simple and reliable manner, each time the user wishes to replace a blade and blade-holder set of the skate.

The invention thus solves the problem set forth above, achieving many advantages.

A first advantage is that blades of different geometrical configurations can be mounted on the same body so that the skate can be used for different skating disciplines.

Moreover, by virtue of the provision of a blade-holder according to the invention, the height, and consequently the weight, of the blade of each set (blade and blade-holder) can advantageously be reduced; in particular, the blade can be limited purely to the portion intended for contact with the sole, the function of providing stiffness, particularly torsional stiffness, and the structural continuity of the blade relative to the body being entrusted to the wedge-shaped attachment portion.

The reduction in the weight of the blade also advantageously permits the provision of sets of blades and respective blade-holders of relatively low overall weight, and having the desired geometrical configurations to satisfy the user's various skating requirements.

Naturally, in order to satisfy contingent and specific requirements, an expert in the art may apply to the skate of the present invention many modifications and variations all of which, however, are included within the scope of protection of the invention as defined by the following claims.

What is claimed is:

1. An ice skate with interchangeable ice-skate blades, comprising:

a first set including a first ice-skate blade, with a first geometric configuration and a length, and a corresponding first blade-holder disposed along substantially the entire length of the first ice-skate blade;

at least one second set including a second ice-skate blade, with a second geometric configuration differing from the first geometric configuration of the first ice-skate blade and a length, and a corresponding second blade-holder disposed along substantially the entire length of the second ice-skate blade;

a body defining a seat receiving directly, without an intervening adapter, and alternatively any one of the blade-holders;

means for restraining one of the blade-holders in the seat and against the body; and at least one tie engaging each ice-skate blade and extending between the ice-skate blade and the body through the corresponding blade-holder, the restraining means being interposed between the at least one tie and the body in order to clamp directly the corresponding ice-skate blade against the body with a clamping load;

the first set and the second set being interchangeably replaceable in the seat of the body so that ice-skate blades of different geometrical configurations can be mounted on the ice skate, thereby permitting use of the ice skate for different disciplines.

2. The ice skate according to claim 1, in which the blade-holders of the sets are molded on the respective blades.

3. The ice skate according to claim 1, in which each blade-holder comprises an attachment portion received and restrained in the seat of the body.

4. The ice skate according to claim 3, in which the attachment portion of the blade-holder has a wedge-shaped cross-section.

5. The ice skate according to claim 1, wherein the seat defined in the body extends along the length of the body corresponding to the length of each blade-holder.

6. The ice skate according to claim 1, wherein the body has holes affording access to the restraining means from outside the body for the purpose of clamping the blade-holder to the body or, alternatively, removing it therefrom.

7. The ice skate according to claim 6, in which the restraining means comprises:

(a) an externally-threaded portion fixed to one of the respective tie and the body; and (b) an internally-threaded member engaged with the externally-threaded portion and abutting the other of the respective tie and the body, at least one of the externally-threaded portion and the internally-threaded member being accessible from outside the body through the holes in order to clamp the blade-holder to the body or, alternatively, to remove it therefrom.

8. The ice skate according to claim 1, in which there are two ties arranged in longitudinally opposed regions of the body.

9. The ice skate according to claim 8, in which the ties extend in substantially parallel directions.

10. The ice skate according to claim 1, in which the restraining means comprises an eccentric clamping device operatively connected to the tie in order to move it from an inoperative position in which the blade-holder is removed from the body, to an operative position in which the blade-holder is clamped against the body as a result of the application of the clamping load by the tie.

11. The ice skate according to claim 10, in which the clamping device comprises a member supported for rotating about a first axis on the body, the at least one tie being articulated to the member about a second axis parallel to and spaced from the first axis, the tie being movable between the inoperative and operative positions as a result of a rotation of the member about the first axis, and the member being accessible from outside the body through the holes.

12. The ice skate according to claim 10, in which the at least one tie is fixed to the clamping device in an adjustable manner by a threaded coupling.

13. The ice skate according to claim 10, in which there are two ties each of which is operatively connected to a respective eccentric clamping device.

14. The ice skate according to claim 10, wherein each blade-holder has an attachment portion engaging the seat of the body in order to couple the blade-holder releasably to the body.

15. The ice skate according to claim 1, in which the seat comprises a groove formed in the body.

16. The ice skate according to claim 1, in which the first blade-holder and the second blade-holder have substantially identical geometric configurations.

17. An ice skate with interchangeable ice-skate blades, comprising:

a first set including a first ice-skate blade, with a first geometric configuration and a length, and a corresponding first blade-holder disposed along substantially the entire length of the first ice-skate blade and having an attachment portion;

at least one second set including a second ice-skate blade, with a second geometric configuration differing from the first geometric configuration of the first ice-skate blade and a length, and a corresponding second blade-holder disposed along substantially the entire length of the second ice-skate blade and having an attachment portion;

a body having shaped means for engaging directly and without an intervening adapter the attachment portion of one of the blade-holders;

at least one tie positioned between one of the ice-skate blades and the body; and an eccentric clamping device operatively connected to the tie in order to move the tie from an inoperative position in which one of the blade-holders is removed from the body, to an operative position in which one of the blade-holders is restrained in the shaped engagement means and is clamped against the body as a result of the application of a clamping load by the tie, the device having:

(a) a member supported for rotating about a first axis on the body, and (b) an element forming an extension of the tie and articulated to the member in an eccentric position relative to the first axis, the element being articulated to the member about a second axis parallel to and spaced from the first axis, the tie being movable between the inoperative and operative positions as a result of rotation of the member about the first axis;

the first set and the second set being interchangeably replaceable in the shaped engagement means of the body so that ice-skate. blades of different geometrical configurations can be mounted on the ice skate, thereby permitting use of the ice skate for different disciplines.

18. The ice skate according to claim 17, in which the shaped engagement means comprises a seat.

19. The ice skate according to claim 18, wherein the seat defined in the body comprises a groove extending along the length of the body corresponding to the length of each blade-holder.

20. The ice skate according to claim 17, in which the attachment portion of each blade-holder has a wedge-shaped cross-section.

21. The ice skate according to claim 17, in which the blade-holders of the sets are molded on the respective blades.

22. The ice skate according to claim 17, wherein the body has holes affording access to the member from outside the body for the purpose of clamping the blade-holder to the body or, alternatively, removing it therefrom.

23. The ice skate according to claim 17, in which there are two ties arranged in longitudinally opposed regions of the body.

24. The ice skate according to claim 23, in which the ties extend in substantially parallel directions.

25. The ice skate according to claim 17, in which the at least one tie is fixed to the clamping device in an adjustable manner by a threaded coupling.

26. The ice skate according to claim 17, in which there are two ties each of which is operatively connected to a respective eccentric clamping device.

27. The ice skate according to claim 17, in which the at least one tie engages each ice-skate blade and extends between the ice-skate blade and the body through the corresponding blade-holder in order to clamp directly the corresponding ice-skate blade against the body with a clamping load.

28. The ice skate according to claim 17, in which the first blade-holder and the second blade-holder have substantially identical geometric configurations.

29. An ice skate with interchangeable ice-skate blades, comprising:

a first set including:

(a) a first ice-skate blade with a first geometric configuration and a length, and (b) a corresponding first blade-holder molded on the first ice-skate blade, disposed along substantially the entire length of the first ice-skate blade, and having an attachment portion with a wedge-shaped cross-section;

at least one second set including:

(a) a second ice-skate blade with a second geometric configuration differing from the first geometric configuration of the first ice-skate blade and a length, and (b) a corresponding second blade-holder molded on the second ice-skate blade, disposed along substantially the entire length of the second ice-skate blade, and having an attachment portion with a wedge-shaped cross-section;

a body having holes and defining a seat that receives directly, without an intervening adapter, and alternatively any one of the blade-holders, the seat extending along the length of the body corresponding to the length of each blade-holder and receiving the attachment portion of the respective blade-holder;

means for restraining one of the blade-holders in the seat and against the body, the holes in the body providing access to the restraining means from outside the body for the purpose of clamping the blade-holder to the body in an adjustable manner or, alternatively, removing it therefrom; and at least one tie engaging each ice-skate blade and extending between the ice-skate blade and the body through the corresponding blade-holder, the restraining means being interposed between the at least one tie and the body in order to clamp directly the corresponding ice-skate blade against the body with a clamping load;

the first set and the second set being interchangeably replaceable in the seat of the body so that ice-skate blades of different geometrical configurations can be mounted on the ice skate, thereby permitting use of the ice skate for different disciplines.

* * * * *